US009963946B2

(12) United States Patent
Delmar et al.

(10) Patent No.: US 9,963,946 B2
(45) Date of Patent: May 8, 2018

(54) METHOD OF FILLING A CORING TOOL INNER BARREL WITH A CORING FLUID

(71) Applicant: HALLIBURTON ENERGY SERVICES, INC., Houston, TX (US)

(72) Inventors: Ludovic Delmar, Braine l'alleud (BE); Benjamin Llywelyn Evans, Uccle (BE)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 14/762,309

(22) PCT Filed: Dec. 24, 2013

(86) PCT No.: PCT/US2013/077638
§ 371 (c)(1),
(2) Date: Jul. 21, 2015

(87) PCT Pub. No.: WO2015/099695
PCT Pub. Date: Jul. 2, 2015

(65) Prior Publication Data

US 2015/0361740 A1 Dec. 17, 2015

(51) Int. Cl.

| | |
|---|---|
| ***E21B 25/00*** | (2006.01) |
| ***E21B 21/00*** | (2006.01) |
| ***E21B 10/02*** | (2006.01) |
| ***E21B 21/08*** | (2006.01) |
| ***E21B 47/00*** | (2012.01) |

(52) U.S. Cl.
CPC ..... *E21B 21/00* (2013.01); *E21B 10/02* (2013.01); *E21B 21/08* (2013.01); *E21B 25/00* (2013.01); *E21B 47/00* (2013.01)

(58) Field of Classification Search
CPC ..... E21B 25/00; E21B 25/005; E21B 25/02; E21B 25/04; E21B 25/06; E21B 25/08; E21B 25/10; E21B 25/12; E21B 25/14; E21B 25/16; E21B 25/18
See application file for complete search history.

(56) References Cited

U.S. PATENT DOCUMENTS 2,862,691 A 12/1958 Cochran
2,880,969 A 4/1959 Williams
(Continued)

FOREIGN PATENT DOCUMENTS

BE 1012111 A3 5/2000 ..... E21B 25/08
CN 1629446 6/2005
(Continued)

OTHER PUBLICATIONS

Office Action, Australian Patent Application No. 2013408889, 2 pages, dated Jul. 22, 2016.
(Continued)

*Primary Examiner* — Robert E Fuller
*Assistant Examiner* — Steven A MacDonald
(74) *Attorney, Agent, or Firm* — Baker Botts L.L.P.

(57) ABSTRACT

A method for obtaining a core sample from a wellbore using a coring tool is disclosed. The method includes providing an outer barrel in the wellbore. The wellbore and outer barrel are at least partially filled with a drilling fluid. The method further includes lowering an inner barrel partially into the drilling fluid and displacing the drilling fluid in the inner barrel with a coring fluid.

18 Claims, 9 Drawing Sheets

(56) References Cited

U.S. PATENT DOCUMENTS

| | | | | | |
|---|---|---|---|---|---|
| 3,064,742 | A * | 11/1962 | Bridwell | E21B 25/08 | 175/226 |
| 3,146,837 | A * | 9/1964 | Bridwell | E21B 25/08 | 175/244 |
| 3,454,117 | A * | 7/1969 | Eckel | E21B 25/08 | 175/226 |
| 3,463,248 | A * | 8/1969 | Bell | E21B 27/02 | 166/162 |
| 4,356,872 | A * | 11/1982 | Hyland | E21B 25/08 | 175/226 |
| 4,598,777 | A * | 7/1986 | Park | E21B 25/08 | 175/226 |
| 4,716,974 | A * | 1/1988 | Radford | E21B 25/08 | 175/59 |
| 5,482,123 | A | 1/1996 | Collee et al. | | |
| 5,546,798 | A | 8/1996 | Collee et al. | | |
| 6,283,228 | B2 | 9/2001 | Collee et al. | | |
| 6,695,075 | B2 * | 2/2004 | Beeker | E02D 1/04 | 175/226 |
| 6,695,076 | B2 | 2/2004 | Masui et al. | | |
| 7,013,993 | B2 | 3/2006 | Masui et al. | | |
| 7,093,676 | B2 | 8/2006 | Puymbroeck et al. | | |
| 7,124,841 | B2 | 10/2006 | Wada et al. | | |
| 7,308,951 | B2 | 12/2007 | Masui et al. | | |
| 2002/0139583 | A1 | 10/2002 | Masui et al. | | |
| 2005/0106751 | A1 | 5/2005 | Masui et al. | | |
| 2005/0133267 | A1 | 6/2005 | Reid, Jr. et al. | | |
| 2010/0012392 | A1 | 1/2010 | Zahradnik et al. | | |
| 2012/0012392 | A1 * | 1/2012 | Kumar | E21B 25/00 | 175/58 |
| 2013/0240267 | A1 | 9/2013 | Aleksandersen et al. | | |

FOREIGN PATENT DOCUMENTS

| | | | | |
|---|---|---|---|---|
| CN | 1740511 | | 3/2006 | |
| CN | 203175400 | | 9/2013 | |
| CN | 103415672 | | 11/2013 | |
| JP | 562135748 | A | 6/1987 | G01N 1/04 |
| JP | 2004191364 | | 7/2004 | |

OTHER PUBLICATIONS

International Preliminary Report on Patentability and Written Opinion received for PCT Patent Application No. PCT/US2013/077638, dated Jul. 7, 2016, 5 pages.

International Search Report and Written Opinion, Application No. PCT/US2013/077638, 9 pages, dated Sep. 25, 2014.

Office Action received for Canadian Patent Application No. 2,931,375, dated Jun. 12, 2017; 3 pages.

Office Action received for Chinese Patent Application No. 201380081025.2, dated May 17, 2017; 10 pages.

* cited by examiner

METHOD OF FILLING A CORING TOOL INNER BARREL WITH A CORING FLUID

CROSS-REFERENCE TO RELATED APPLICATION

This application is a U.S. National Stage Application of International Application No. PCT/US2013/077638 filed Dec. 24, 2013, which is incorporated herein by reference in its entirety.

TECHNICAL FIELD

The present disclosure relates generally to downhole coring operations and, more particularly, to coring tools with a tubular housing and methods for filling the tubular housing inner barrel with a coring fluid.

BACKGROUND

Conventional coring tools for obtaining core samples from a borehole contain a tubular housing attached at one end to a special bit often referred to as a coring bit, and at the other end to a drill string extending through the borehole to the surface. The tubular housing includes an inner and an outer barrel with a space between. During typical drilling, the drilling fluid, also referred to as drilling mud or simply mud, may fill part of the coring tool and other parts of the drilling assembly. The inner barrel, however, may be filled with a coring fluid and may flow through the interior of the inner barrel. The coring fluid may be non-invasive and non-reactive to prevent jamming and assist in the removal of the core sample. The coring fluid may also have other properties that allow it to remain in the inner barrel and not be replaced by the drilling fluid. The core sample enters and fills the inner barrel, which is then subsequently recovered to the surface.

BRIEF DESCRIPTION OF THE DRAWINGS

For a more complete understanding of the present disclosure and its features and advantages, reference is now made to the following description, taken in conjunction with the accompanying drawings, in which:

FIG. 3A illustrates a first step of FIG. 3;

FIG. 3B illustrates a second step of FIG. 3;

FIG. 3C illustrates a third step of FIG. 3;

FIG. 3D illustrates a fourth step of FIG. 3;

FIG. 3E illustrates a fifth step of FIG. 3;

FIG. 5A illustrates a first step of FIG. 5;

FIG. 5B illustrates a second step of FIG. 5;

FIG. 5C illustrates a third step of FIG. 5;

FIG. 5D illustrates a fourth step of FIG. 5;

FIG. 5E illustrates a fifth step of FIG. 5;

FIG. 5F illustrates a sixth step of FIG. 5; and

DETAILED DESCRIPTION

The present disclosure relates to coring tools and methods of filling the tubular housing inner barrel of a coring tool with a coring fluid. These coring tools and methods may use pumping or pressure differences to draw the coring fluid into the coring tool, facilitating filling of the coring tool downhole. These coring tools and methods may be used in conjunction with a pressure measurement, used to determine a filling method, or in the absence of a pressure measurement.

Additionally, the coring fluid may be designed to facilitate obtaining and measuring parameters of a high quality core sample. The coring fluid may have a density lower than that of a drilling fluid surrounding the coring tool. Alternatively, it may have a density that is the same as or higher than that of the drilling fluid. The density of the coring fluid as compared to the drilling fluid or the viscosity of the coring fluid may help retain it in the inner barrel.

As compared to prior coring tools and methods, those of the present disclosure may be more versatile or easier-to-use and may also provide higher quality core samples or core sample measurements.

Embodiments of the present disclosure and their advantages may be better understood by referring to FIGS. 1-6, where like numbers are used to indicate like and corresponding parts.

Figure 1:
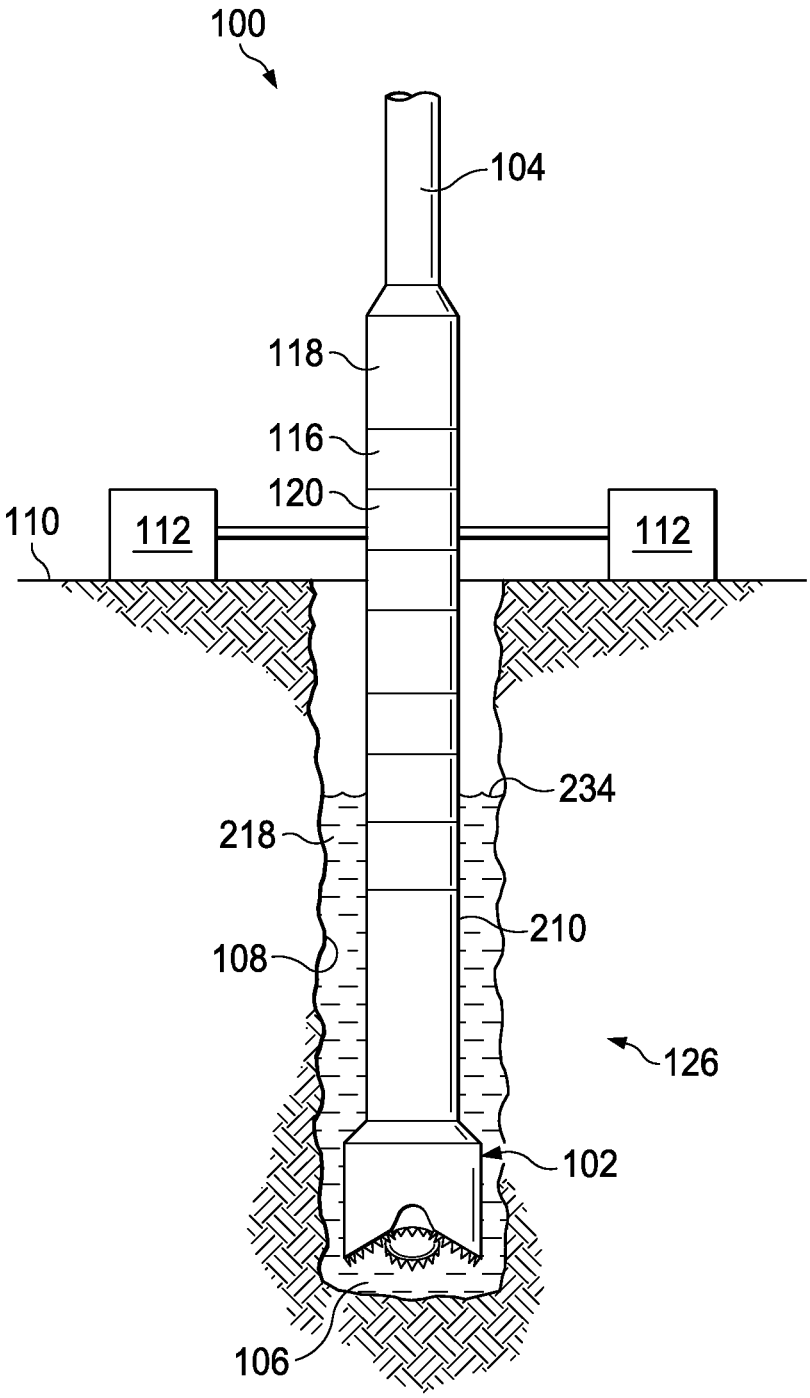
FIG. 1 illustrates a schematic diagram of a drilling assembly containing a coring tool, in accordance with some embodiments of the present disclosure.

FIG. 1 illustrates a schematic diagram of a drilling assembly 100 with a coring tool 126 in wellbore 106 in accordance with some embodiments of the present disclosure. Drilling assembly 100 may include a well surface, sometimes referred to as "well site" 110. Various types of drilling equipment such as a rotary table, drilling fluid pumps and drilling fluid tanks may be located at well site 110. For example, well site 110 may include a drilling rig that may have various characteristics and features associated with a "land drilling rig," such as a rig floor. However, drilling assemblies incorporating teachings of the present disclosure may be satisfactorily used with drilling equipment located on offshore platforms, drill ships, semi-submersibles and drilling barges (not expressly shown). Further, well site 110 may include drilling fluid pumps 112 that may be utilized to pump drilling fluid downhole during operation of coring tool 126.

Coring tool 126 may be suspended by drill string 104 in wellbore 106 defined by sidewall 108. Drill string 104 may include one or more electrical conductors and a multi-strand cable, such as an armored logging cable. Drill string 104 may encompass the cables and conductors. In some embodiments, drill string 104 may be extended into wellbore 106.

In some embodiments, drill string 104 may include components of a bottom hole assembly (BHA) 118. BHA 118 may be formed from a wide variety of components configured to form a wellbore 106. For example, BHA 118 may include, but is not limited to, drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components and different types of components included in BHA 118 may depend upon anticipated downhole drilling conditions and the type of wellbore that will be formed.

Drilling assembly 100 may include swivel assembly 116 located proximate to and downhole from BHA 118. The terms "uphole" and "downhole" may be used to describe the location of various components of drilling system 100 relative to the bottom or end of wellbore 106 shown in FIG. 1. For example, a first component described as uphole from a second component may be further away from the end of wellbore 106 than the second component. Similarly, a first component described as being downhole from a second component may be located closer to the end of wellbore 106 than the second component. In some embodiments, swivel assembly 116 may be an integrated component of coring tool 126. Swivel assembly 116 may be utilized to isolate rotation of and torque used in rotation of coring bit 102 from other components of coring tool 126, such as the inner barrel (not expressly shown).

Drilling assembly 100 may further include a filling port, such as filling sub, which may be a separate element or a component of the coring tool 126 with other functions, that may have one or more sub valves for adding fluid to or withdrawing fluid from the interior of coring tool 126. Filling sub 120 may be located downhole from swivel assembly 116 and uphole from coring bit 102. In some embodiments, filling sub 120 may be an integrated component of coring tool 126. Although filling port, such as filling sub 120 and other filling ports depicted in other embodiments here illustrate filling coring tool 126 or another coring tool from the top or upper portion thereof, one of ordinary skill in the art will appreciate that the coring tool may be filled from another location, such as the bottom or lower portion or partially between the top and bottom. Such filling location may be determined simply by positioning the filling port at the filling location.

Coring tool 126 may be coupled to and extend down from well site 110. Coring tool 126 may include coring bit 102. Coring bit 102 may be any of various types of fixed cutter drill bits, including polycrystalline diamond cutter (PDC) bits, including thermally stable polycrystalline diamond cutter (TSP) bits, drag bits, matrix drill bits, steel body drill bits, and impreg bits operable to extract a core sample from wellbore 106. Coring bit 102 may be designed and formed in accordance with teachings of the present disclosure and may have many different designs, configurations, or dimensions according to the particular application of coring bit 102.

Coring tool 126 may further include outer barrel 210 and an inner barrel (discussed in detail with reference to FIG. 2) located inside outer barrel 210. Coring tool 126 may be partially or fully lowered into wellbore 106, which contains drilling fluid 218. Drilling fluid 218 may rise to drilling fluid level 234. In some embodiments, the inner barrel may be filled with a coring fluid to prevent jamming, reduce invasion, preserve the core sample, increase lubrication at core/tube interface or for any other suitable purpose. There may be multiple methods for filling the inner barrel of coring tool 126 with the coring fluid. The inner barrel may be filled utilizing filling sub 120 or another element containing subvalves while portions of the inner barrel are downhole. The fluid may fill the inner barrel based on a pressure differential in place of a piston or other mechanism, which may simplify the filling technique over prior methods.

In one method (discussed in detail below with reference to FIG. 3), utilized when there is approximately equal or positive pressure proximate to the top or head ($P_{head}$) of the inner barrel (or proximate filling sub 120), the inner barrel is lowered into outer barrel 210. The $P_{head}$ is positive when the ratio of the density of drilling fluid 218 to the density of the coring fluid is greater than the ratio of the total inner barrel length to the length of the inner barrel lowered into drilling fluid 218. Coring fluid is pumped into the inner barrel through an inlet valve of filling sub 120 and fills the inner barrel until coring fluid is exiting an outlet valve of filling sub 120. When valves are closed, the coring tool 126 may be operated in-hole to extract a core sample.

In a second method (discussed in detail below with reference to FIG. 5), utilized when the pressure is negative (vacuum) proximate the head of the inner barrel (or proximate filling sub 120), the inner barrel is lowered into outer barrel 210, and a filling mechanism is connected, such as filling sub 120. The $P_{head}$ is negative when the ratio of the density of drilling fluid 218 to the coring fluid is less than the ratio of the inner barrel length to length of the inner barrel lowered in drilling fluid 218. In this case, the inlet valve of filling sub 120 is closed and the outlet valve of filling sub 120 is set as a one way valve. The inner barrel is lowered into drilling fluid 218 until filling sub 120 is below drilling fluid line 234. As long as the bottom of the inner barrel remains in drilling fluid 218, then drilling fluid 218 will remain in the inner barrel. The inlet valve of filling sub 120 is connected to a coring fluid tank and coring fluid is pulled into the inner barrel. Coring tool 126 may then be operated in-hole to extract a core sample.

Figure 2:
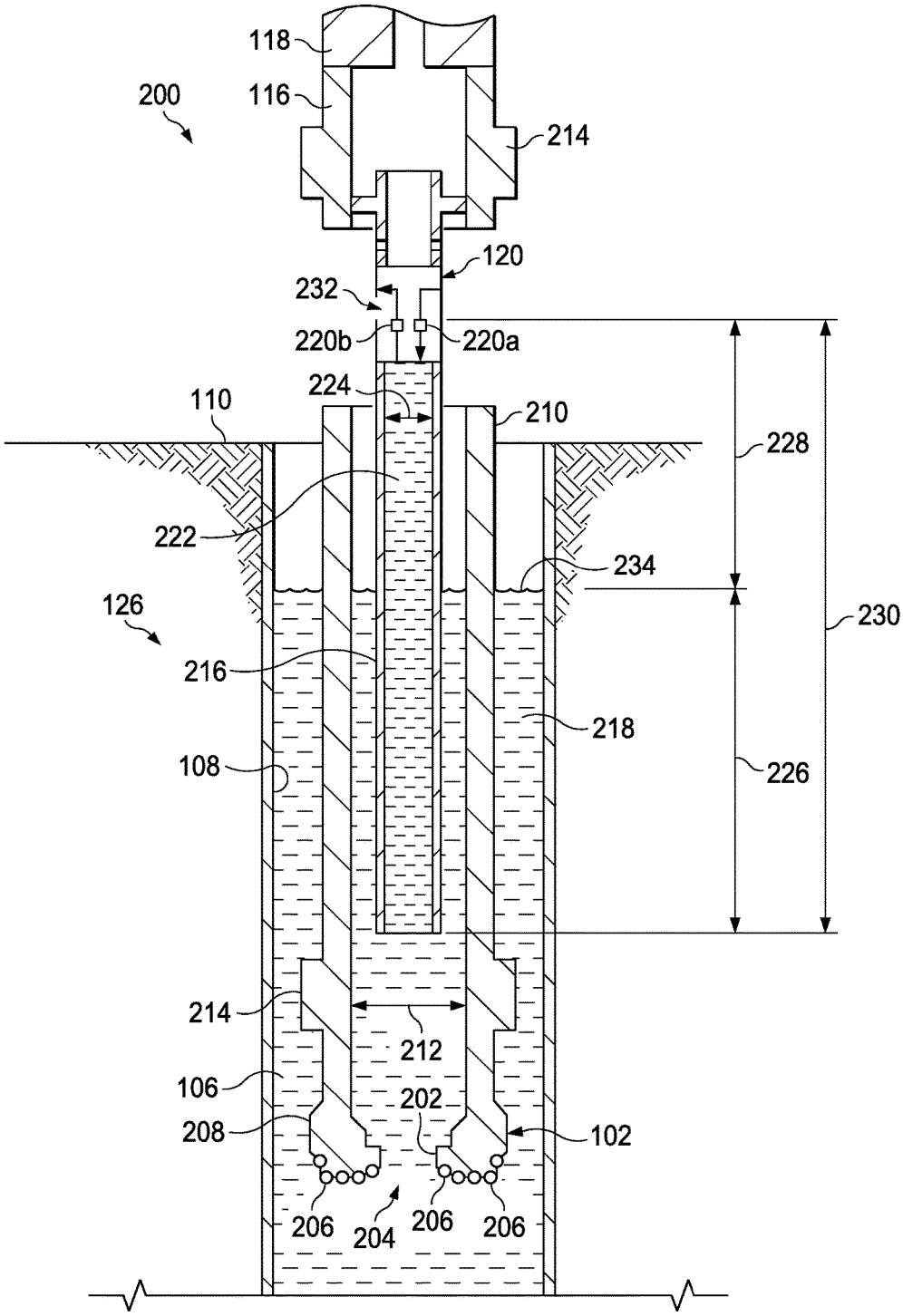
FIG. 2 illustrates a cross-sectional view of an example coring tool for extracting a core sample from a wellbore, in accordance with some embodiments of the present disclosure.

FIG. 2 illustrates a cross-sectional view of an example coring tool 200 for extracting a core sample from wellbore 106, in accordance with some embodiments of the present disclosure. Coring tool 200 may include a coring bit, such as coring bit 102. Coring bit 102 may have a generally cylindrical body and inner gage 202. Coring bit 102 may further include throat 204 that may extend longitudinally through coring bit 102. Throat 204 of coring bit 102 may allow a core sample to be cut with a smaller diameter than throat 204 or approximately the diameter of throat 204. Coring bit 102 may include one or more cutting elements 206 disposed outwardly from exterior portions of bit body 208. For example, a portion of cutting element 206 may be directly or indirectly coupled to an exterior portion of bit body 208 while another portion of cutting element 206 may be projected away from the exterior portion of bit body 208. Cutting elements 206 may be any suitable device configured to cut into a formation, including but not limited to, primary cutting elements, back-up cutting elements, secondary cutting elements or any combination thereof. By way of example and not limitation, cutting elements 206 may be various types of cutters, compacts, buttons, inserts, and gage cutters satisfactory for use with a wide variety of coring bits 102.

Cutting elements 206 may include respective substrates with a layer of hard cutting material disposed on one end of each respective substrate. The hard layer of cutting elements 206 may provide a cutting surface that may engage adjacent portions of wellbore 106. Each substrate of cutting elements 206 may have various configurations and may be formed from tungsten carbide or other materials associated with forming cutting elements for coring bits. Tungsten carbides may include, but are not limited to, monotungsten carbide (WC), ditungsten carbide ($W_2C$), macrocrystalline tungsten carbide and cemented or sintered tungsten carbide. Substrates may also be formed using other hard materials, which may include various metal alloys and cements such as metal borides, metal carbides, metal oxides and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials and cubic boron nitride.

In operation, coring bit 102 may extract a core sample from a formation of interest approximately the diameter of or a smaller diameter than throat 204. Coring bit 102 may be coupled to or integrated with outer barrel 210. Outer barrel 210 may also be referred to as a "core barrel" or "outer tube." Coring bit 102 may have a generally cylindrical body and may have a longitudinal opening 212 that may correspond to throat 204. Barrel stabilizers 214 may be integral to outer barrel 210. Barrel stabilizers 214 may be utilized to stabilize and provide consistent stand-off of outer barrel 210 from sidewall 108. Further, outer barrel 210 may include additional components, such as sensors, receivers, transmitters, transceivers, sensors, calipers, and/or other electronic components that may be used in a downhole measurement system or other particular implementation. Outer barrel 210 may be coupled to and remain in contact with well site 110 during operation.

Inner barrel 216 may pass through outer barrel 210. Inner barrel 216 may have a generally cylindrical body and longitudinal opening 224. Inner barrel 216 may capture a core sample (not expressly shown). In some embodiments, inner barrel 216 may contain an inner sleeve (not expressly shown) for capturing a core sample. Inner barrel 216 may be encompassed by outer barrel 210. In some embodiments, inner barrel 216 or may extend beyond outer barrel 210 Inner barrel 216 may be fluted to facilitate fluid movement and minimize "hydraulic jamming." Following extraction from wellbore 106, a core sample may be stored and later retrieved and lifted to the surface. A core sample may be lifted to the surface by retrieving inner barrel 210 or an inner sleeve (not expressly shown), or by extraction of the drilling assembly from wellbore 106 Inner barrel 216 may be configured to slideably move uphole and downhole partially within outer barrel 210. Further, a float valve (not expressly shown) may be placed in the drill string to help avoid coring fluid loss as inner barrel 216 moves to well site 110.

Filling sub 120 may be coupled to and located uphole from inner barrel 216. Filling sub 120 may include one or more valves 220. For example, filling sub 120 may include inlet valve 220*a* and outlet valve 220*b*. Valves 220 may be one-way valves, check valves, or three-way valves. Further, filling sub outlet valve 220*b* may include a pressure rated check valve, which may be adjusted based on pressure proximate to filling sub 120, $P_{head}$, to facilitate minimizing the risk of hydraulic jamming. Filling sub 120 may be configured to provide coring fluid 222 to and remove coring fluid 222 from opening 224 of inner barrel 216.

Swivel assembly 116 may be located uphole from filling sub 120. Swivel assembly 116 may be configured to couple to outer barrel 210 and maintain inner barrel 216 inside outer barrel 210.

Drilling fluid 218 may be found in wellbore 106 up to drilling fluid level 234. Drilling fluid 218 may be formed from fluids mixing with downhole debris during drilling. Drilling fluid 218 may extend around outer barrel 210 between sidewall 108 and exterior portions of outer barrel 210. Drilling fluid 218 may also extend up through throat 204 into opening 212 of outer barrel 210. Drilling fluid 218 may extend between the exterior of inner barrel 216 and the interior of outer barrel 210.

In some embodiments, coring fluid 222 may fill up and be maintained in opening 224 of inner barrel 216. For example, coring fluid 222 may have a lower density than drilling fluid 218. Because coring fluid 222 has as lower density than drilling fluid 218 and is thus, more buoyant, coring fluid 222 will remain inside inner barrel 216 and not substantially mix with drilling fluid 218. Further, the density of coring fluid 222 may be adjusted to minimize $P_{head}$ and therefore, any check valve pressure rating. Moreover, using a coring fluid 222 that is clean or substantially free-of particles or suitable for wave transmission may allow an electronic device to measure advancement of the core sample inside inner barrel 216

In some embodiments, multiple methods may exist to place and maintain coring fluid 222 inside inner barrel 216. For example, the pressure, $P_{head}$, at valves 220 of filling sub 120 may be utilized to determine a method for filling inner barrel 216 with coring fluid. In order to determine an appropriate filling method, measurements, which may be approximate, may be made, including: the distance from the drilling fluid level 234 to valves 220 (shown by span 228), the distance from the downhole end of inner barrel 216 and drilling fluid level 234 (shown by span 226), and the distance from the downhole end of inner barrel 216 and valves 220 (shown by span 230). Positive pressure at $P_{head}$ head may exist when:

$$\frac{\text{Drilling fluid density}}{\text{Coring fluid density}} > \frac{\text{Inner barrel length [span 230]}}{\text{Inner barrel length below drilling fluid level [span 226]}} \quad (1)$$

Negative pressure, e.g., vacuum, may exist at $P_{head}$ head when:

$$\frac{\text{Drilling fluid density}}{\text{Coring fluid density}} > \frac{\text{Inner barrel length [span 230]}}{\text{Inner barrel length below drilling fluid level [span 226]}} \quad (2)$$

$P_{head}$ may be calculated by the following equation:

$$P_{head}=(\text{Drilling fluid density}\times\text{Inner barrel below drilling fluid level [span 226]}-\text{Coring fluid density}\times\text{Inner barrel [span 230]})\times 0.0981 \quad (3).$$

Table 1 illustrates example configurations for coring tool 126. In one example, inner barrel 216 has a length of approximately fifty-four meters and is disposed in drilling fluid 218 inside outer barrel 210 approximately fifty-two meters. Thus, approximately two meters of inner barrel 216 is exposed above drilling fluid level 234. With a drilling fluid 218 density of approximately 1.8 kg/l and a coring fluid 222 density of approximately 0.9 kg/l, $P_{head}$ is approximately 4.4 bar. Thus, for any particular configuration of inner barrel 216 and density of both drilling fluid 218 and coring fluid 222, the value of $P_{head}$ head may be determined and a filling method may be chosen.

TABLE 1

| | Ex. 1 | Ex. 2 | Ex. 3 | Ex. 4 | Ex. 5 | Ex. 6 | Ex. 7 |
|---|---|---|---|---|---|---|---|
| Inner barrel length - span 230 (m) | 54 | 54 | 54 | 9 | 54 | 9 | 54 |
| Inner barrel length below drilling fluid level - span 226 (m) | 52 | 47 | 47 | 7 | 52 | 7 | 52 |
| Inner barrel length above drilling fluid level - span 228 (m) | 2 | 7 | 7 | 2 | 2 | 2 | 2 |
| Drilling fluid density (kg/l) | 1.8 | 1.8 | 1.4 | 1.4 | 1.2 | 1.2 | 1.4 |
| Coring fluid density (kg/l) | 0.9 | 0.9 | 0.9 | 0.9 | 0.9 | 0.9 | 0.9 |
| $P_{head}$ (bar) | 4.4 | 3.5 | 1.7 | 0.2 | 1.4 | 0.0 | 2.4 |

FIG. 3A-3E illustrates a step diagram of coring tool 300 in multiple stages for filling inner barrel 216 when the pressure proximate to filling sub valves 220 is either zero or positive. FIG. 3 includes five stages, shown in FIGS. 3A-3E. However, more or fewer stages or configurations may be included in some embodiments of the present disclosure.

Figure 3C:
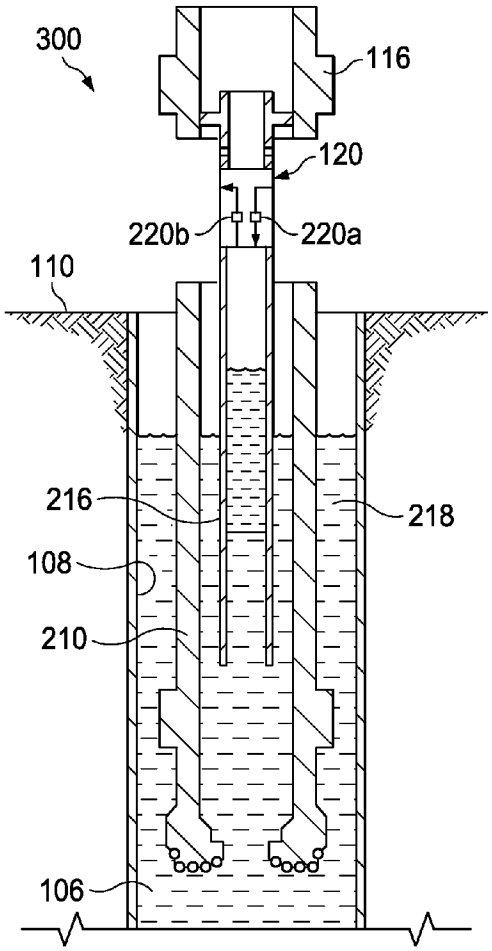
FIG. 3A-3E illustrates a step diagram of a coring tool in multiple stages of filling an inner barrel when the pressure proximate to filling sub valves is either zero or positive, in accordance with some embodiments of the present disclosure.
Figure 3B:
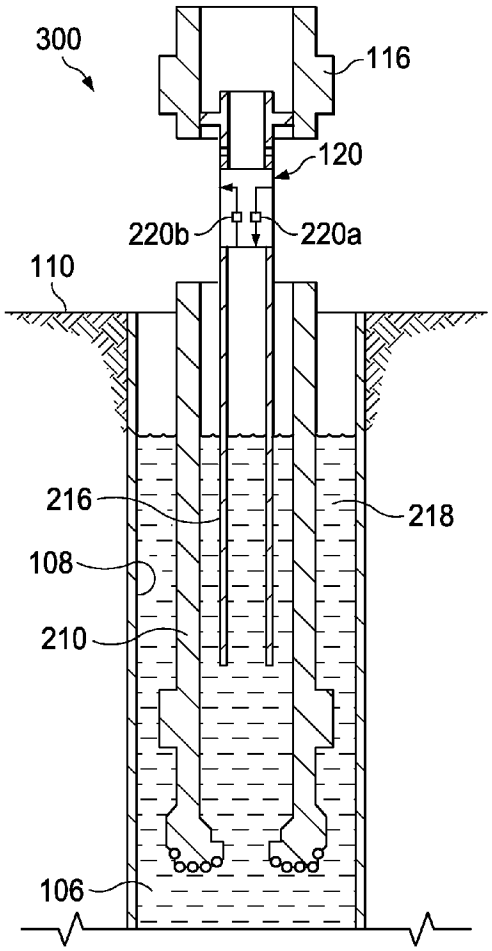
Figure 3A:
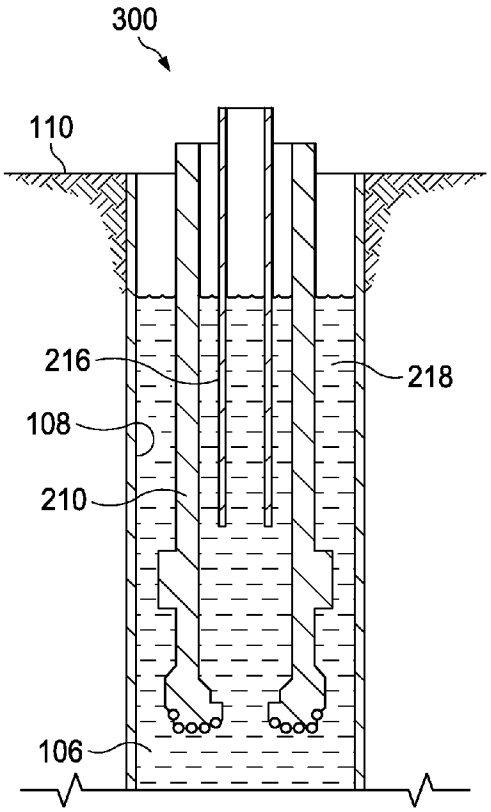

FIG. 3A illustrates inner barrel 216 being lowered into outer barrel 210. Outer barrel 210 may be located inside wellbore 106 prior to the insertion of inner barrel 216. Inner barrel 216 is lowered partially into outer barrel 210 and opening 224 of inner barrel 216 may fill with drilling fluid 218 up to drilling fluid level 234.

FIG. 3B illustrates a coupling of filling sub 120 to inner barrel 216. Filling sub 120 may be mechanically coupled in any suitable manner to inner barrel 216, e.g., threadably attached or any other locking mechanism. Filling sub 120 forms a seal with uphole end of inner barrel 216 such that substantially no coring fluid 222 is able to exit at the interface between inner barrel 216 and filling sub 120. Based on the zero or positive pressure at $P_{head}$, inner barrel 216 may tend to float up and out of outer barrel 210. Connection of filling sub 120 assists in keeping inner barrel 216 inside outer barrel 210 based on the weight of filling sub 120. Further, swivel assembly 116 or components of BHA 118 may be coupled to filling sub 120. The weight associated with swivel assembly 116 or components of BHA 118 may additionally serve to retain inner barrel 216 inside outer barrel 210. In some embodiments, other types of weights may be utilized to retain inner barrel 216 inside outer barrel 210.

FIG. 3C illustrates the filling of coring fluid 222 into inner barrel 216. Filling sub 120 is configured such that inlet valve 220*a* is connected to a fluid source or pump, such as pump 112 shown with reference to FIG. 1. Outlet valve 220*b* is configured to be open to allow air and fluid to exit from opening 224 of inner barrel 216. Additional techniques for filling the inner barrel include pumping from the top of inner barrel 216 using a device such as, but not limited to a piston, a solid or viscous plug, or a foam ball. As inner barrel 216 fills with fluid, the mud is expelled through the lower part of the inner assembly, sometimes referred to as the shoe.

Figure 3D:
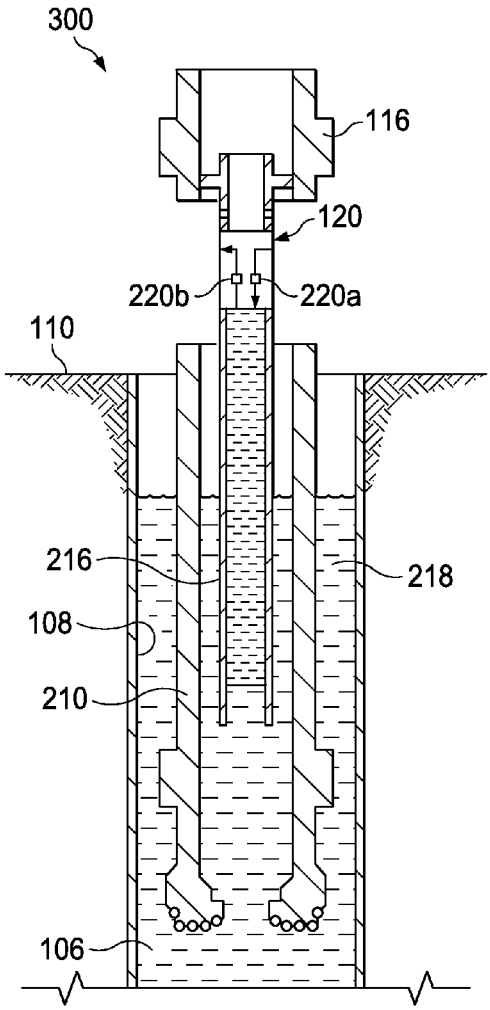

FIG. 3D illustrates inner barrel 216 filled with coring fluid 222. Outer valve 220*b* may be closed when inner barrel 216 is sufficiently full of coring fluid 222, e.g., when fluid 222 begins to exit outer valve 220*b*. Closing outer valve 220*b* causes the pressure in opening 224 of inner barrel 216 to increase.

Figure 3E:
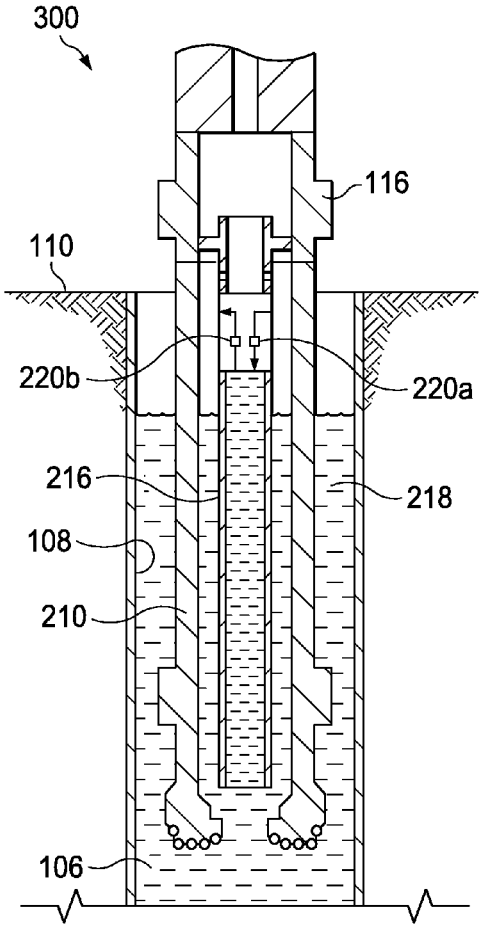

FIG. 3E illustrates a coring tool being operated to extract a core sample. Inner barrel 216 is lowered into outer barrel 210 and coring tool is operated in-hole to extract a core sample.

Figure 4:
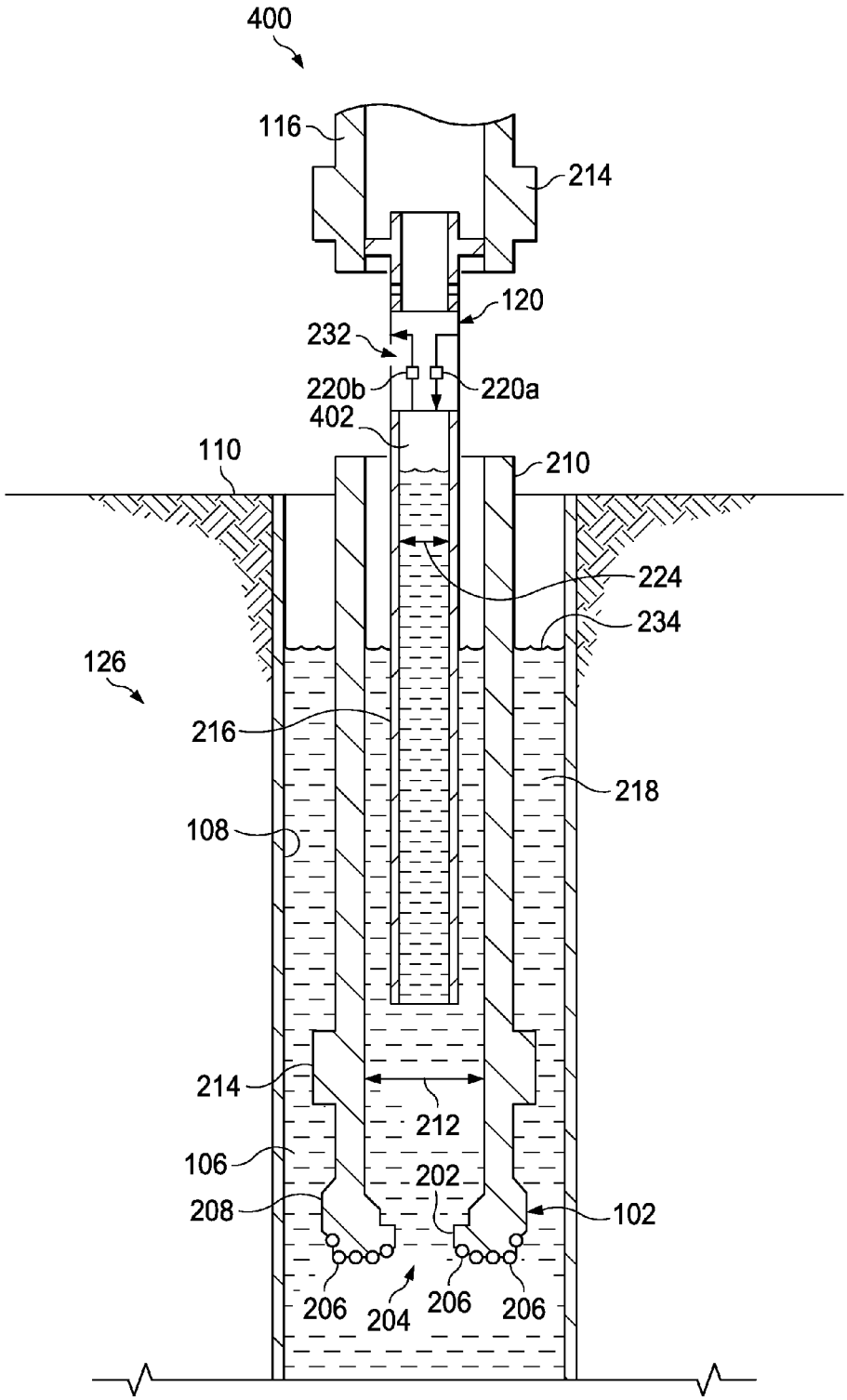
FIG. 4 illustrates a cross-sectional view of an example coring tool with a volume of trapped air, in accordance with some embodiments of the present disclosure.

FIG. 4 illustrates a cross-sectional view of an example coring tool 400 with a volume of trapped air 402. As noted, the method described with respect to FIG. 3 may be effective if $P_{head}$ is zero or positive. If $P_{head}$ is negative, e.g., a vacuum, however, coring fluid 222 may escape through the downhole end of inner barrel 216 before inner barrel 216 is substantially filled with coring fluid 222.

In this case, a volume of air becomes trapped at the uphole end of inner barrel 216. If the volume of trapped air is below a particular amount, the method described with respect to FIG. 3 may still be utilized depending on the overall coring process and coring tool. The volume of trapped air may be approximated by the approximate length (in inner barrel 216) of the trapped air. The length of trapped air may be estimated by the following equation:

$$\text{Trapped air} = \text{Inner barrel [span 230]} - \frac{\text{Inner barrel below drilling fluid level [span 226]} \times M\ \text{Drilling fluid density}}{\text{Coring fluid density}}.$$

Table 2 illustrates examples of configurations when the trapped air volume is low enough for methods or FIG. 3 and drilling assembly 300 to be utilized.

TABLE 2

| | Ex. 1 | Ex. 2 | Ex. 3 | Ex. 4 | Ex. 5 | Ex. 6 | Ex. 7 |
|---|---|---|---|---|---|---|---|
| Inner barrel length - span 230 (m) | 9 | 9 | 18 | 27 | 54 | 18 | 27 |
| Inner barrel length below drilling fluid level - span 226 (m) | 2 | 2 | 11 | 20 | 47 | 16 | 25 |
| Inner barrel length above drilling fluid level - span 228 (m) | 7 | 7 | 7 | 7 | 7 | 2 | 2 |
| Drilling fluid density (kg/l) | 1.1 | 1.8 | 1.4 | 1.2 | 1.2 | 1.2 | 1.2 |
| Coring fluid density (kg/l) | 0.9 | 0.9 | 0.9 | 1.1 | 1.1 | 1.1 | 0.9 |
| Length of air trapped (m) | 6.6 | 5.0 | 0.9 | 5.2 | 2.7 | 0.5 | −6.3 |

FIG. 5A-5F illustrates coring tool 500 in multiple stages for filling inner barrel 216 when the pressure proximate to filling sub valves 220 is negative. FIG. 5 includes six stages, shown in FIGS. 5A-5F. However, more or fewer stages or configurations may be included in some embodiments of the present disclosure.

Figure 5A:
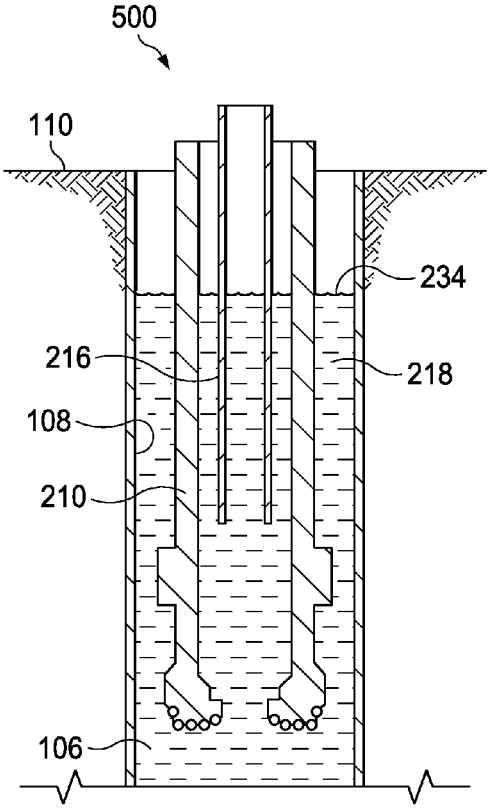
FIG. 5A-5F illustrates a step diagram of a coring tool in multiple stages for filling an inner barrel when the pressure proximate to filling sub valves is negative, in accordance with some embodiments of the present disclosure.

FIG. 5A illustrates inner barrel 216 being lowered into outer barrel 210. Outer barrel 210 may be located inside wellbore 106 prior to the insertion of inner barrel 216. Inner barrel 216 is lowered partially into outer barrel 210 and opening 224 of inner barrel 216 may fill with drilling fluid 218 up to drilling fluid level 234.

Figure 5B:
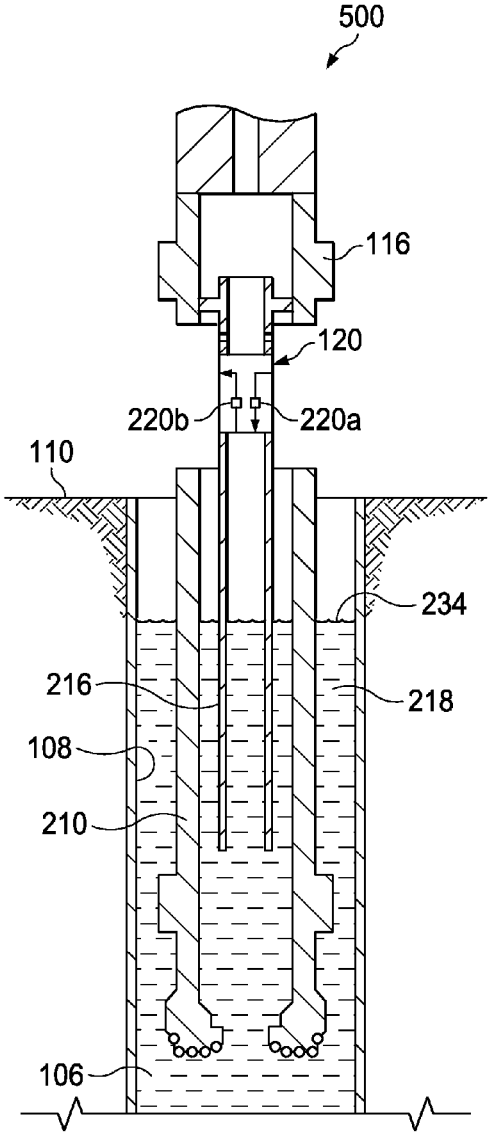

FIG. 5B illustrates a coupling of filling sub 120 to inner barrel 216. Filling sub 120 may be mechanically coupled in any suitable manner to inner barrel 216, e.g., threadably attached or locked using any other locking mechanism. Filling sub 120 may form a seal with uphole end of inner barrel 216 such that substantially no coring fluid 222 is able to exit at the interface between inner barrel 216 and filling sub 120. Further, swivel assembly 116 and/or components of BHA 118 may be coupled to filling sub 120.

Figure 5C:
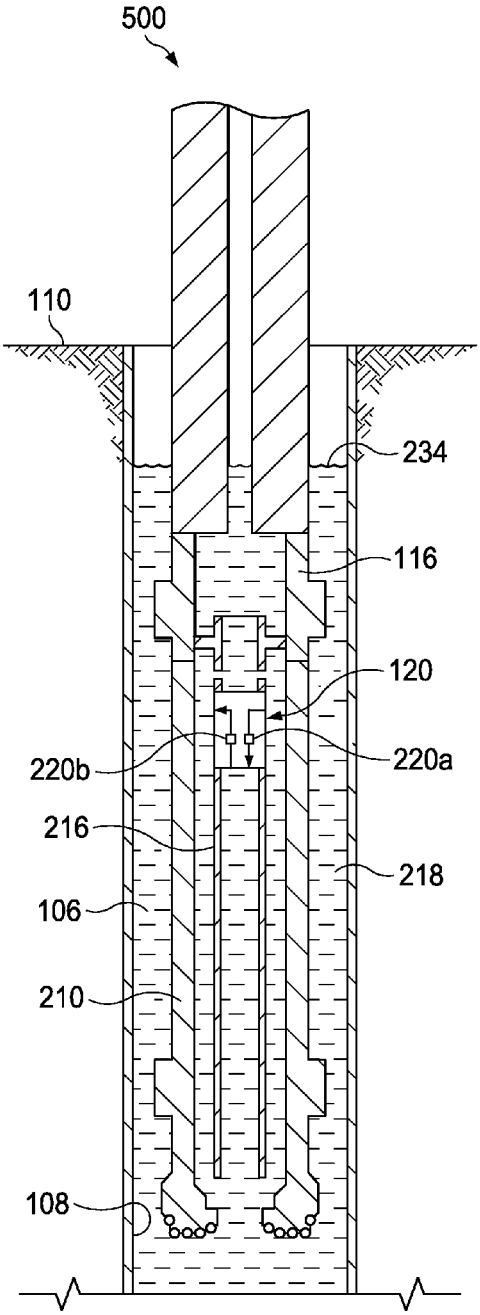

FIG. 5C illustrates the lowering of inner barrel 216 and outer barrel 210 into drilling fluid 218 until filling sub 120 is below drilling fluid level 234. Filling sub 120 may be configured such that inlet valve 220*a* is closed. Outlet valve 220*b* may be configured to be open as a one way valve to allow air and fluid to exit from opening 224 of inner barrel 216.

Figure 5D:
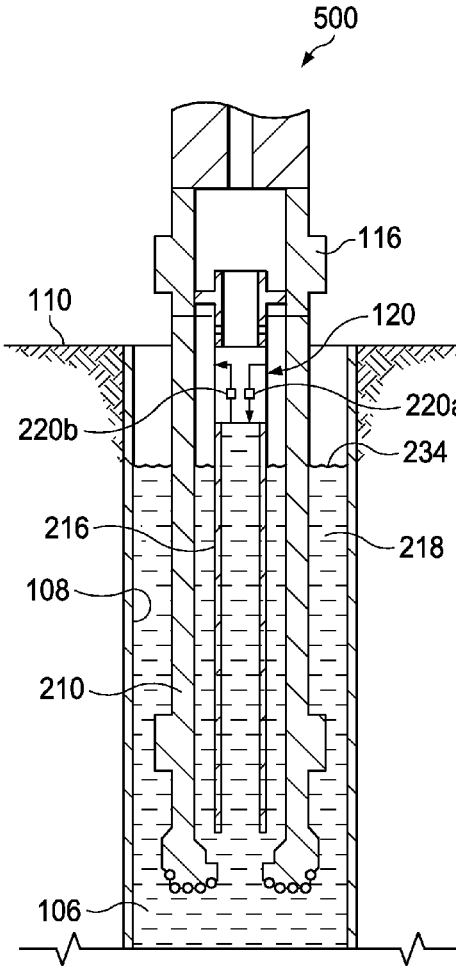

FIG. 5D illustrates inner barrel 216 filled with drilling fluid 218. Outer barrel 210 may be raised and set back in the rotary table (not expressly shown). As long as the bottom of inner barrel 216 remains in drilling fluid 218, drilling fluid 218 will remain in inner barrel 216.

Figure 5E:
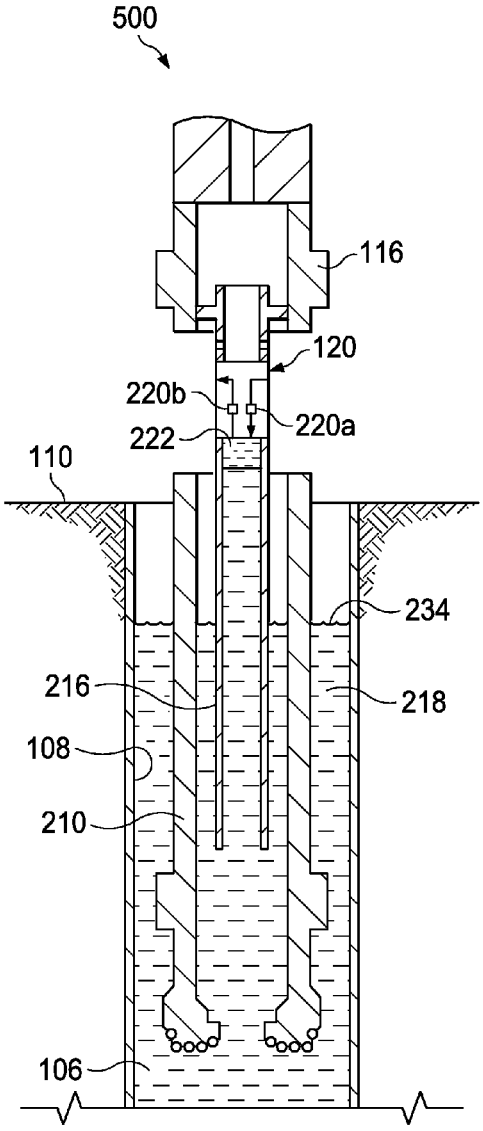

FIG. 5E illustrates swivel assembly 116 raised to allow access to filling sub 210. Filling sub 120 may be configured such that inlet valve 220*a* is connected to a fluid source, such as a coring fluid source, and, optionally also a pump, such as pump 112 shown with reference to FIG. 1. Because there is negative pressure, e.g., vacuum, at the filling sub level, then fluid from inlet valve 220*a* is pulled into inner barrel 216. A pump, such as pump 112, may be utilized to increase the flow rate through inlet valve 220*a*.

Figure 5F:
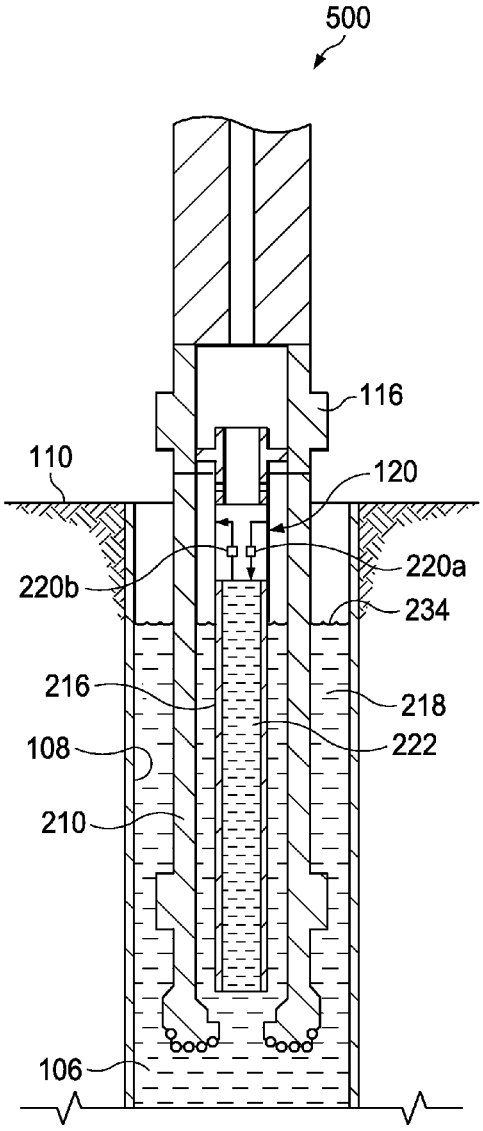

FIG. 5F illustrates inner barrel 216 filled with coring fluid 222. When inner barrel 216 is sufficiently filled with coring fluid 222, inlet valve 220*a* may be closed. Inner barrel 216 may be lowered into outer barrel 210, swivel assembly 116 may be reattached, and the coring tool may be operated in-hole to extract a core sample. As the core sample is extracted, maintaining fluid 222 inside inner barrel 216 minimizes contamination of the core sample by drilling fluid.

Figure 6:
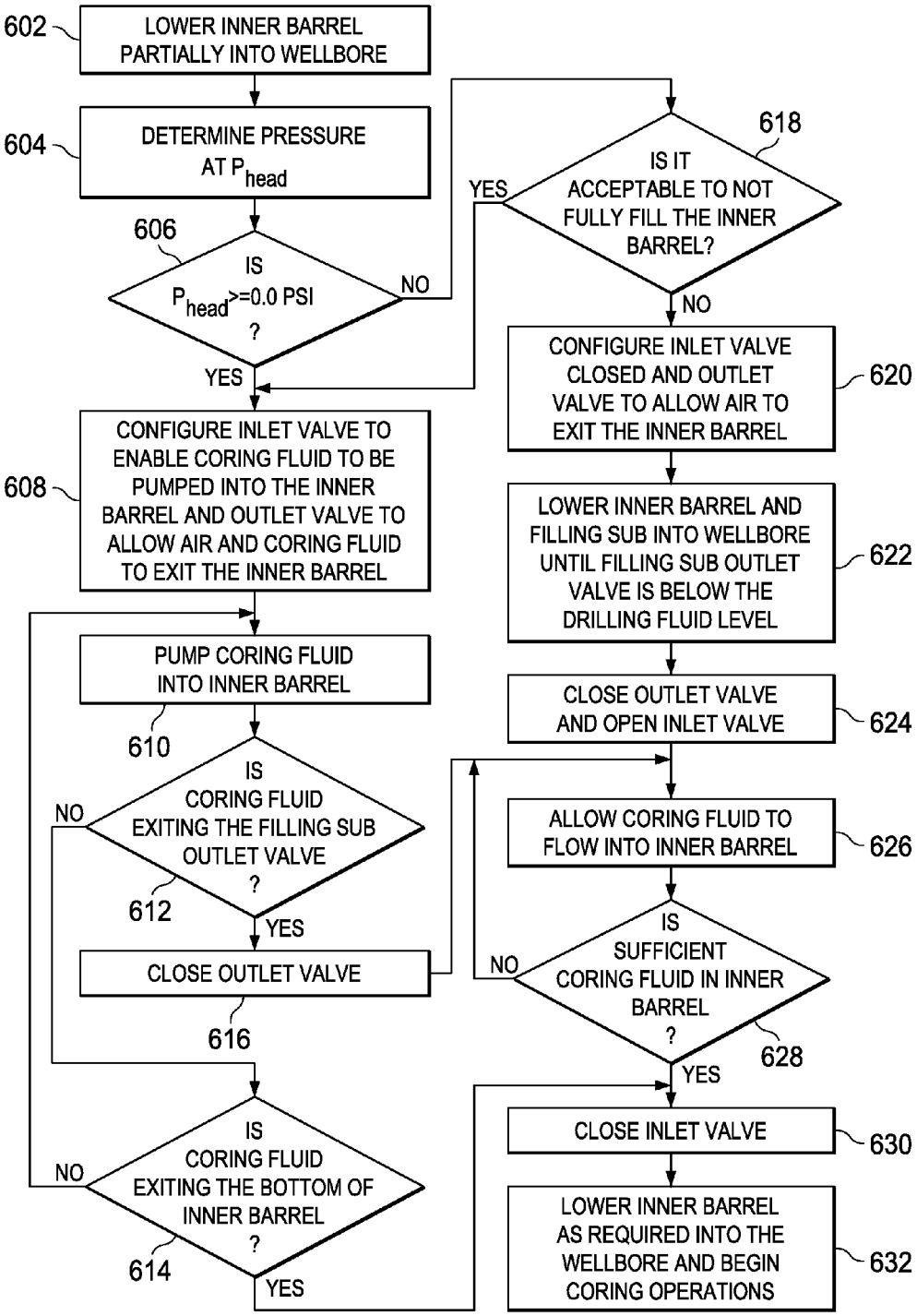
FIG. 6 illustrates a flow chart of an example method for filling a coring tool inner barrel with a fluid, in accordance with some embodiments of the present disclosure.

FIG. 6 illustrates a flow chart of an example method 600 for filling a coring tool inner barrel with a fluid. The steps of method 600 may be performed by various users, automated systems (e.g., valve controllers), installers, computer programs, or any combination thereof, able to assemble and operate a coring tool, perform measurements, or log or analyze results. The programs may include instructions stored on a computer readable medium and operable to perform, when executed, one or more of the steps described below. The computer readable medium may include any system, apparatus or device configured to store and retrieve programs or instructions such as a hard disk drive, a compact disc, flash memory or any other suitable device. The programs may be configured to direct a processor or other suitable unit to retrieve and execute the instructions from the computer readable media. For illustrative purposes, method 600 is described with respect to coring tool 200 of FIG. 2; however, method 600 may be used to fill an inner barrel with a fluid for any suitable coring tool or drilling assembly.

Method 600 may start at step 602, includes lowering an inner barrel partially into a wellbore, e.g., an outer barrel or BHA that is located in a wellbore from which a core sample is to be extracted. For example, inner barrel 216 may be lowered into outer barrel 210 as shown with reference to FIGS. 2, 3A, and 5A. Further, the method includes coupling a filling sub and swivel assembly, if necessary, to an inner barrel or outer barrel. For example, filling sub 120 may be coupled to inner barrel 216 and swivel assembly 116 may be coupled to outer barrel 210 as shown with reference to FIGS. 3B and 5B. Filling sub 120 and swivel assembly 116 may be utilized to retain inner barrel 216 inside outer barrel 210.

At step 606, the method includes determining the pressure proximate to the top (uphole end) of the inner barrel or the filling sub, $P_{head}$. For example, a user may determine the pressure proximate to the top of the inner barrel or the filling sub 120 utilizing Equations (1), (2), and (3) shown above. At step 608, the method includes determining if the pressure at step 606 is greater than or equal to approximately zero pound per square inch (psi). If the pressure at $P_{head}$ is positive or zero psi, method 600 may proceed to step 610. If the pressure at $P_{head}$ is negative, method 600 may proceed to step 618.

At step 610, the method includes configuring an inlet valve on the filling sub to enable coring fluid to be pumped into the inner barrel. Further, an outlet valve on the filling sub may be configured to allow air and coring fluid to exit the inner barrel. For example, as discussed with reference to FIG. 3C, filling sub 120 may be configured such that inlet valve 220*a* is connected to a fluid source, such as a coring fluid source, or optionally also a pump, such as pump 112 shown with reference to FIG. 1. Outlet valve 220*b* may be configured to be open to allow air and coring fluid to exit from opening 224 of inner barrel 216.

At step 612, the method includes pumping coring fluid into an inner barrel. As shown in FIG. 3C, coring fluid 222 may be pumped into inner barrel 216 through inlet valve 220*a*. At step 614, the method includes determining if fluid is exiting the filling sub outlet valve. Once coring fluid 222 begins to exit outlet valve 220, inner barrel 216 is being filled of coring fluid 222, as shown with reference to FIG. 3D. If coring fluid is not yet exiting the outlet valve, method 600 may proceed to step 615. At step 615, method 600 may determine if coring fluid is exiting the bottom (downhole end) of the inner barrel. For example, with reference to FIG. 3D, it may be determined if coring fluid 222 is exiting the downhole end of inner barrel 216. If coring fluid is exiting the downhole end of the inner barrel, method 600 may proceed to step 632. If coring fluid is not exiting the downhole end of inner barrel 216, method 600 may return to step 612.

If coring fluid is exiting the outlet valve at step 614, method 600 may continue to step 616 in which the outlet valve is closed. At step 628, the method includes allowing coring fluid to flow into the inner barrel. For example, FIG. 3D illustrates coring fluid 222 filling inner barrel 216. As another example, FIG. 5E illustrates swivel assembly 116 raised to allow access to filling sub 210. Filling sub 120 is configured such that inlet valve 220*a* is connected to a fluid source or, optionally, also a pump, such as pump 112 shown with reference to FIG. 1. If there is negative pressure, e.g., vacuum, at the filling sub level, then fluid from inlet valve 220*a* may be pulled into the inner assembly. A pump, such as pump 112, may be utilized to increase the flow rate through inlet valve 220*a*.

At step 630, the method includes determining if sufficient coring fluid is in the inner barrel. Once coring fluid 222 begins to exit outlet valve 220 and air is bled from inner barrel 216, inner barrel 216 is sufficiently full of coring fluid 222, as shown with reference to FIGS. 3E and 5F. If coring fluid is not yet exiting the outlet valve, method 600 may return to step 628. If coring fluid is exiting the outlet valve, method 600 may continue to step 632 in which the inlet valve is closed.

At step 634, the method includes lowering the inner barrel as needed into the wellbore, e.g., outer barrel or BHA, to begin coring operations. For example, inner barrel 216 and outer barrel 210 may be lowered into a wellbore 106 to extract a core sample as shown in FIGS. 3E and 5F.

If at step 608 the pressure measured at step 606 is negative, method 600 may proceed to step 618 to determine if it is acceptable to not fully fill the inner barrel. For example, an insignificant volume of air may be trapped in the inner barrel. As shown in FIG. 4, if an insignificant amount of air 402 is trapped at the top of inner barrel 216, method 600 may proceed to step 610. If the amount of trapped air 402 is significant, e.g., over a particular volume selected by the user, then method 600 may proceed to step 620.

At step 620, the method includes configuring a filling sub inlet valve as closed and a filling sub outlet valve as open to allow air to exit the inner barrel. For example, in FIG. 5C, filling sub 120 is configured such that inlet valve 220*a* is closed. Outlet valve 220*b* is configured to be open as a one way valve to allow air and coring fluid to exit from opening 224 of inner barrel 216.

At step 622, the method includes lowering the inner barrel and filling sub downhole, e.g., into the outer barrel or BHA, until the filling sub outlet valve is below the drilling fluid level. FIG. 5C illustrates the lowering of inner barrel 216 and outer barrel 210 into drilling fluid 218 until outlet valve 220*b* is below drilling fluid level 234. FIG. 5D illustrates inner barrel 216 filled with drilling fluid 218. The filling sub may be raised above the drilling fluid level.

At step 626, the method includes closing the outlet valve and opening the inlet valve. For example in FIG. 5D, outer barrel 210 is raised and set back in the rotary table. As long as the bottom of inner barrel 216 remains in drilling fluid 218, drilling fluid 218 will remain in inner barrel 216. Method 600 may then proceed to step 628.

Modifications, additions, or omissions may be made to method 600 without departing from the scope of the present disclosure. For example, the order of the steps may be performed in a different manner than that described and some steps may be performed at the same time. Additionally, each individual step may include additional steps without departing from the scope of the present disclosure.

In one additional embodiment, determining the pressure may be omitted. Instead, both the methods of filling the inner barrel may be performed.

In another additional embodiment, determining the pressure may be omitted and one of the two general methods may be used. If the method most appropriate when pressure is positive is used when pressure is negative instead, then the inner barrel would not be fully filled, but coring could still take place. If the method most appropriate when pressure is negative is used when pressure is positive instead, the inner barrel will be filled fully but the method will take longer to perform.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. In contrast, to LWD and MWD, wireline techniques involve the removal of all or part the drilling assembly from the wellbore and insertion of a wireline logging tool. LWD, MWD and wireline techniques are compatible with coring operations. Accordingly, embodiments of the present disclosure may supplement or alter the embodiments disclosed in FIGS. 1-6 in order to facilitate their use with downhole information collection.

For example, drilling assemblies and methods may be used in connection with wireline coring. During wireline coring, the tubular housing, which contains an inner barrel and an outer barrel, is typically located at the bottom of a wellbore, which may be many thousands of feet below the surface. In such embodiments, the entire tubular housing is submerged in drilling fluid, in contrast to the embodiments shown in FIGS. 1-5, in which the outer barrel is only partially submerged in drilling fluid. The wireline assembly may be similar to and include parts of the drilling assembly and may be configured substantially as shown in FIGS. 1-5, particularly with respect to the coring tool and any pumps or valves, and filling with coring fluid may proceed substantially as shown in FIG. 6 even when the tubular housing is submerged in drilling fluid, in connection with wireline coring or any other techniques during which submersion occurs. In addition, although the inner barrel is often at least partially lowered in to the wellbore with the outer barrel in the embodiments for FIGS. 1-6, when performing wireline coring, the inner barrel may be lowered through the drill string instead. In particular, it may be lowered in a component of the drill string, such as the drill pipe, the drill collar, or a BHA component.

Embodiments of the present disclosure may also facilitate transmission of measurements and data to the surface using telemetry, such as mud pulses, wired communications, or wireless communications from a downhole telemetry system to a surface control unit. The downhole telemetry system may include a recording module, a downhole controller, and the drilling assembly or analogous assembly containing any pumps and valves and the coring tool. The downhole telemetry system may be part of or communicatively coupled with the BHA or the drilling assembly or analogous assembly.

The surface control unit may include a processor coupled to a computer readable medium that contains a program. The program, when executed by the processor, may cause the processor to perform certain actions. The surface control unit may transmit commands to elements of the BHA or the drilling assembly or analogous assembly containing any pumps and valves and the coring tool using mud pulses or other communication media that are received at the telemetry system. Likewise, the telemetry system may transmit information to the surface control unit from elements in the BHA. For example, parameters related to the core sample or filling of the inner tube may be transmitted to the surface control unit through the telemetry system.

Like the surface control unit, the downhole controller may include a processor coupled to a computer readable medium. The downhole controller may issue commands to elements within the BHA, to the drilling assembly or analogous assembly, or to any pumps or valves for controlling filling of the inner barrel. The commands may be issued in response to a separate command from the surface control unit, or the downhole controller may issue the command without being prompted by the surface control unit. For example, valves may open or close and pumping may begin or cease in response to a command.

The surface control unit or the downhole controller may measure various parameters, such as opening or closing of filling ports, filling of the inner tube, entry of a core sample into the inner tube, and evaluation of the content of fluids. In particular, the amounts of materials form the core sample, such as methane, oil, carbon dioxide and hydrogen sulfide may be measured, particularly if the coring fluid is largely free of particles. Measurements may be made using light emission, reflection, transmission, or refraction or using ultrasonic wave emission, reflection, transmission, or refraction.

Although the present disclosure and its advantages have been described in detail, it should be understood that various changes, substitutions and alternations can be made herein without departing from the spirit and scope of the disclosure as defined by the following claims.

The invention claimed is:

1. A method for obtaining a core sample, the method comprising:

providing an outer barrel in a wellbore, the outer barrel at least partially filled with a drilling fluid;

lowering an inner barrel partially into the drilling fluid;

filling the inner barrel with a coring fluid by allowing a vacuum to pull the coring fluid into the inner barrel via at least one filling port, thereby displacing at least a portion of drilling fluid in the inner barrel with the coring fluid; and operating a coring bit in the wellbore to extract a core sample into the coring fluid.

2. The method of claim 1, further comprising determining a pressure at the filing sub based on a ratio of a density of a coring fluid to a density of the drilling fluid; and filling the inner barrel with the coring fluid using a vacuum determined by the pressure at a filling sub.

3. The method of claim 2, wherein the pressure determined at the filling sub is greater than or equal to approximately zero.

4. The method of claim 3, wherein filling the inner barrel with the coring fluid comprises pumping the coring fluid into the inner barrel via at least one filling port.

5. The method of claim 2, wherein the pressure determined at the filling sub is less than zero.

6. The method of claim 1, wherein the density of the coring fluid is less than the density of the drilling fluid.

7. The method of claim 1, further comprising retaining the coring fluid in the inner barrel due to a difference in density of the coring fluid and density of the drilling fluid.

8. The method of claim 1, wherein the coring fluid does not substantially mix with the drilling fluid.

9. The method of claim 1, wherein the coring fluid is substantially debris-free through the filling step.

10. The method of claim 1, further comprising retaining the coring fluid in the inner barrel due to viscosity of the coring fluid.

11. The method of claim 1, wherein filling the inner barrel with a coring fluid via a filling port comprises filling the inner barrel from an upper portion thereof.

12. The method of claim 1, further comprising lowering the inner barrel in the outer barrel into the wellbore.

13. The method of claim 1, further comprising lowering the inner barrel in a drill string into the wellbore.

14. The method of claim 1, wherein filling the inner barrel with the coring fluid comprises pumping the coring fluid into the inner barrel via at least one filling port.

15. The method of claim 1, wherein filling the inner barrel with the coring fluid further comprises pumping the coring fluid into the inner barrel.

16. The method of claim 1, further comprising configuring an inlet valve of the at least one filling port to enable the coring fluid to enter the inner barrel and an outlet valve of the at least one filling port to allow the coring fluid to exit the inner barrel.

17. The method of claim 1, further comprising measuring at least one parameter associated with obtaining a core sample using a downhole controller.

18. The method of claim 17, further comprising measuring a parameter associated with extraction of the core sample into the coring fluid.

* * * * *